US009459079B1

(12) United States Patent
Dudt et al.

(10) Patent No.: US 9,459,079 B1
(45) Date of Patent: Oct. 4, 2016

(54) LIGHTWEIGHT ARMOR WITH SLIDE REGION FOR SLIDABLY REDIRECTING PROJECTILES

(71) Applicants: Philip Dudt, North Bethesda, MD (US); Alyssa Littlestone, Washington, DC (US)

(72) Inventors: Philip Dudt, North Bethesda, MD (US); Alyssa Littlestone, Washington, DC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/871,495

(22) Filed: Sep. 30, 2015

(51) Int. Cl.
*F41H 5/02* (2006.01)
*F41H 5/04* (2006.01)

(52) U.S. Cl.
CPC ..... *F41H 5/023* (2013.01); *F41H 5/0457* (2013.01)

(58) Field of Classification Search
CPC ..... F41H 5/023; F41H 5/02; F41H 5/04; F41H 5/0442; F41H 5/0457
USPC ..... 89/36.02, 903, 904, 910, 914
See application file for complete search history.

(56) References Cited

U.S. PATENT DOCUMENTS

| | | | | |
|---|---|---|---|---|
| 7,938,053 | B1 | 5/2011 | Dudt et al. | |
| 8,220,378 | B2 | 7/2012 | Gamache et al. | |
| 8,226,873 | B1 | 7/2012 | Martin et al. | |
| 8,713,865 | B2 | 5/2014 | Hall | |
| 8,746,122 | B1 * | 6/2014 | Roland | F41H 5/04 89/36.02 |
| 9,140,524 | B2 | 9/2015 | Fingerhut | |
| 2011/0277621 | A1 * | 11/2011 | Joynt | F41H 7/042 89/36.02 |
| 2013/0160640 | A1 * | 6/2013 | Livesey | F41H 5/013 89/36.02 |
| 2014/0060300 | A1 * | 3/2014 | Kucherov | F42D 5/05 89/36.02 |

FOREIGN PATENT DOCUMENTS

DE 3537093 * 4/1987

* cited by examiner

*Primary Examiner* — Stephen M Johnson
(74) *Attorney, Agent, or Firm* — Dave A. Ghatt

(57) ABSTRACT

A lightweight armor for resisting penetration by both fragments and high velocity sharply pointed projectiles. The lightweight armor includes a slide region and a receiving region, with the slide region having a backing material coated with polyurea to slidably redirect projectiles towards the receiving region, which may include high strength thickened projectile stopping materials.

13 Claims, 14 Drawing Sheets

LIGHTWEIGHT ARMOR WITH SLIDE REGION FOR SLIDABLY REDIRECTING PROJECTILES

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a lightweight armor with a slide region and a receiving region, and in particular, the lightweight armor is designed so that the slide region slidably redirects projectiles towards the receiving region where the projectiles are stopped.

BACKGROUND

Military vehicles are subject to attack from high velocity projectiles, including sharply pointed bullets and fragments. The projectiles can penetrate vehicles and cause serious injury or death to the occupants thereof. Thus, these vehicles require armor to protect against these types of attacks. In addition to military vehicles, other vehicles which require armor protection include, for example, limousines, commercial armored cars and other non-military vehicles used for transporting people or high-value cargo.

Over the years, various forms of armor have been developed to provide protection to both the vehicles and the occupants. When developing a specific armor, consideration must be given to the type or types of projectile and energetic force against which the armor must provide protection. Consideration must also be given to the effectiveness of the overall armor system in protecting against multiple threats. Further consideration must be given to the weight of the armor system and to the practicality of use of the armor in view of its weight. To this end, consideration must also be given to the material that is used for the armor.

Currently, armor piercing and other high velocity rounds are defeated by thick high strength steel armor, with or without angled perforations, ceramics, high strength fabrics or combinations of the same. A new component has been added more recently, i.e., highly rate sensitive polymers. This material has been of interest in resisting penetration by fragments, but is not very effective against sharply pointed bullets that tend to pierce through it. It is desired to have an armor system that is lightweight, that protects against multiple threats such as fragments and sharply pointed bullets.

SUMMARY

In one aspect, the invention is a lightweight armor assembly for resisting penetration by both fragments and high velocity sharply pointed projectiles. In this aspect, the lightweight armor assembly includes a structure having a substantially sinusoidal profile in an X-Y coordinate reference system. The substantially sinusoidal profile has a plurality of slide regions for slidably redirecting high velocity projectiles. Each slide region has a substantially V-shaped protrusion elongated in the Y-direction, having an apex and a base. According to the invention, each substantially V-shaped protrusion includes, a backing material having a thickness t, and a polyurea coating over the lightweight material. The polyurea coating has a thickness $t_c$, with the polyurea coating being converted to a lubricated slide surface when contacted by said high velocity projectiles. The substantially sinusoidal profile also has a plurality of receiving regions for receiving and stopping high velocity projectiles, either redirected from the sliding region or emanating from another source. Each receiving region has a substantially flat lateral section, having a thickness T, thicker than the backing material thickness t, the substantially flat lateral section extending in the X-direction between the substantially V-Shaped protrusions and contacting each substantially V-shaped protrusion at a respective base.

BRIEF DESCRIPTION OF THE DRAWINGS

Other features will be apparent from the description, the drawings, and the claims.

DETAILED DESCRIPTION

Figure 1A:
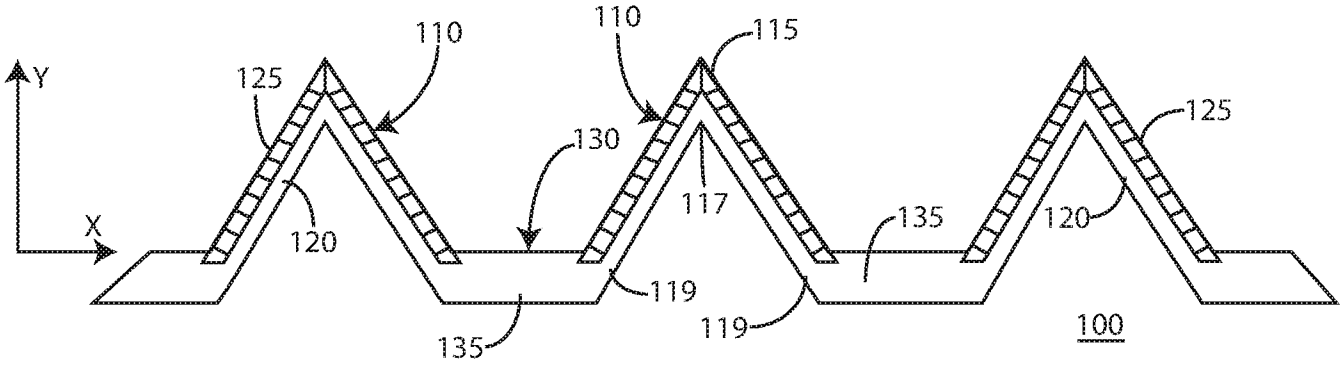
FIG. 1A is an exemplary sectional illustration of a lightweight armor assembly for resisting penetration by both fragments and high velocity sharply pointed projectiles, according to an embodiment of the invention.

FIG. 1A is an exemplary sectional illustration of a lightweight armor assembly 100 for resisting penetration by both fragments and high velocity sharply pointed projectiles, according to an embodiment of the invention. FIG. 1A shows the lightweight armor assembly 100 having slide regions 110 and receiving regions 130. As outlined below, the assembly 100 is designed so that each slide region slidably redirects projectiles towards a receiving region where the projectiles are stopped.

FIG. 1A shows the lightweight armor assembly 100 structured to have a substantially sinusoidal profile, within the illustrated X-Y coordinate reference system. The sinusoidal profile includes the slide regions 110 and the receiving regions 130. As shown, the substantially sinusoidal profile includes substantially V-shaped protrusions 115, each substantially V-shaped protrusion having an apex 117 and a base 119. As shown, the each substantially V-shaped protrusions 115 extend in an elongation Y-direction, which is perpendicular to the X direction. The substantially sinusoidal profile also includes substantially flat lateral sections 135 extending from the base 119 of one substantially V-shaped protrusion 115 to another. As shown, the lightweight armor assembly 100 of FIG. 1A is provided in an X-Y coordinate reference system. The substantially flat lateral sections 135 extend from base 119 to base 119 in the X-direction.

The substantially V-shaped protrusions 115 are the structures that make up the slide regions 110 and the substantially flat lateral sections 135 are the structures that make up the receiving regions 130. Each substantially V-shaped protrusion has a backing material 120. This backing material 120 may be cast armor, high hard steel, aluminum, Ti 6Al-4V titanium alloy, a composite, or any other known material used as armor, or combinations thereof. As outlined below, this backing material 120 is relatively thin as compared to other portions of the assembly 100, and therefore contributes to an overall reduction in the weight of the armor assembly 100. The backing material 120 is known to be used to resist penetration by fragments, but not as effective against high velocity projectiles such as sharply pointed bullets.

Each substantially V-shaped protrusion also includes a polyurea coating 125 over the backing material 120. When bombarded with high-impact and high-velocity projectiles, polyurea converts to a transient liquid phase. This physical characteristic is used to provide the sliding feature of the slide region 110. Thus, when the protrusions 115 are impacted by high-velocity projectiles, instead of penetrating into the surface, the projectiles tend to slide off, as facilitated by the lubricated effect of the transient liquid polyurea.

As stated above, in addition to the substantially V-shaped protrusions 115, the substantially sinusoidal profile of the lightweight armor assembly 100 also includes substantially flat lateral sections 135, which is the structure of the plurality of receiving regions 130 for receiving and stopping high velocity projectiles. In operation the receiving region sees projectiles, either slidably redirected from the slide region 110 or projectiles making contact without first striking the slide region 110. The substantially flat lateral section 135 may be made from high strength thickened steel, Ti 6Al-4V titanium alloy, 7075 T6 Aluminum or other metals or composites known to be used for armor, or combinations thereof. It should be noted that the substantially flat lateral section 135 may be made from the same material as the backing material 120, although not as thin as the backing material 120.

Figure 1B:
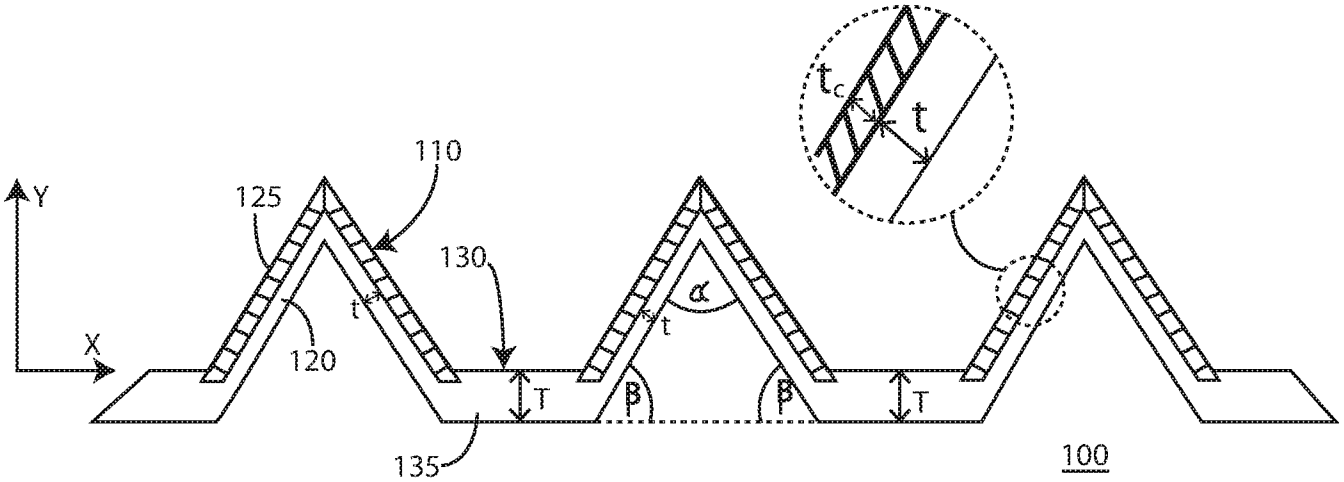
FIG. 1B is an exemplary sectional illustration of the lightweight armor assembly for resisting penetration by both fragments and high velocity sharply pointed projectiles, illustrating dimensional requirements of the assembly, according to an embodiment of the invention.

FIG. 1B is an exemplary sectional illustration of the lightweight armor assembly 100, illustrating dimensional requirements of the assembly, according to an embodiment of the invention. FIG. 1B shows the substantially sinusoidal profile, including the slide regions 110 and the receiving regions 130. As outlined above, the substantially sinusoidal profile includes substantially V-shaped protrusions 115, each having a lightweight backing material 120, and a polyurea coating 125 over the backing material 120. As shown in FIG. 1B, the backing material has a thickness t and the polyurea coating has a thickness $t_c$. FIG. 1B also shows the substantially flat lateral section 135, which may be a thickened high strength steel material, having a thickness T, thicker than the backing material thickness t.

FIG. 1B also shows the substantially V-shaped protrusions 115 having apex angle $\alpha$, and matching base angles $\beta$. According to an embodiment of the invention, the backing material thickness t is about ⅛ inches to about ⅜ inches, and the polyurea coating thickness $t_c$ is about 1/16 inches to about ⅕ inches According to this embodiment, the substantially flat lateral section's thickness T is about ⅝ inches to about 1 inch. According to this embodiment, the apex angle $\alpha$ is about 30 degrees to about 60 degrees. According to a specific embodiment, the apex angle $\alpha$ is about 45 degrees or less.

Figure 1C:
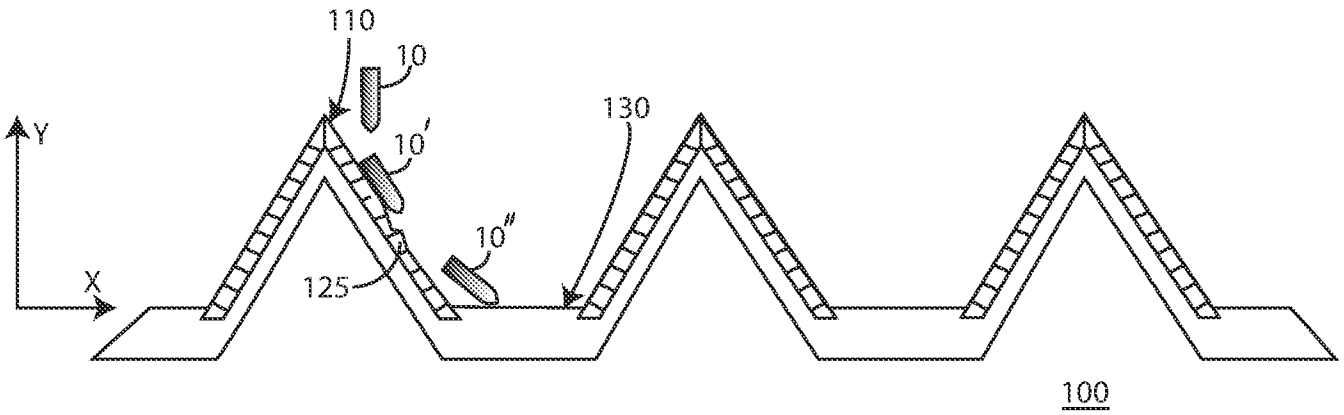
FIG. 1C is an exemplary sectional illustration of the lightweight armor assembly for resisting penetration by both fragments and high velocity sharply pointed projectiles, illustrating the operation of the assembly in negotiating high velocity sharply pointed projectiles, according to an embodiment of the invention.

FIG. 1C is an exemplary sectional illustration of the lightweight armor assembly 100, illustrating the operation of the assembly in negotiating high velocity sharply pointed projectiles, according to an embodiment of the invention. FIG. 1C shows the path taken by a high velocity sharply pointed projectile 10 as it strikes the assembly 100, illustrating how the slide region 110 and the receiving region 130 combine to stop the projectile 10.

As outlined above, each slide region 110 includes a substantially V-shaped protrusion 115, having a lightweight backing material 120 and a polyurea coating 125. When the high velocity sharply pointed projectile 10 strikes the protrusion 115, instead of penetrating into the surface, the projectile 10 slides downwards. Under the impact of the high velocity projectile 10, the polyurea coating 125 converts to a transient liquid phase, which essentially lubricates the surface, thereby causing the projectile 10 to slide downwards. Without the coating 125, the high velocity sharply pointed projectile would probably penetrate into the backing material 120, but the coating 125 in combination with the backing material slidably redirects the projectile 10.

As shown in at position 10' in FIG. 1C, the projectile is slidably redirected off-axis, i.e., rotated to a new angle with respect to its original angular orientation, after contacting the protrusion 115, with the polyurea coating 125 liquefying and having a lubricating effect. The projectile is redirected towards the receiving region 130. As shown, the high velocity sharply pointed projectile 10, at position 10", impacts the substantially flat lateral section 135 of the receiving region 130. Now that the high velocity sharply pointed projectile 10 is off-axis, it is more likely to be stopped by the high strength material of the substantially flat lateral section 135. Although, FIG. 1C only shows the path of a single high velocity sharply pointed projectile 10, the operation of the lightweight armor assembly 100 is consistent with the illustration of FIG. 1C, even though the angle of initial impact with the coating 125 may vary. Essentially, the projectiles slide upon impact with coating 125, and are redirected off-axis towards the receiving area, where the projectiles are stopped.

It should also be noted that the lightweight armor assembly 100 resists penetration by both high velocity sharply pointed projectiles, and fragments. The illustration of FIG. 1C shows how the assembly 100 resists high velocity sharply pointed projectiles. Both the slide region 110 with the lightweight backing material 120 and the receiving region 130 with the high strength material of the substantially flat lateral section 135 are also know for resisting fragments. Thus, the assembly 100 is effective at protecting against both fragments and high velocity sharply pointed projectiles.

Figure 2:
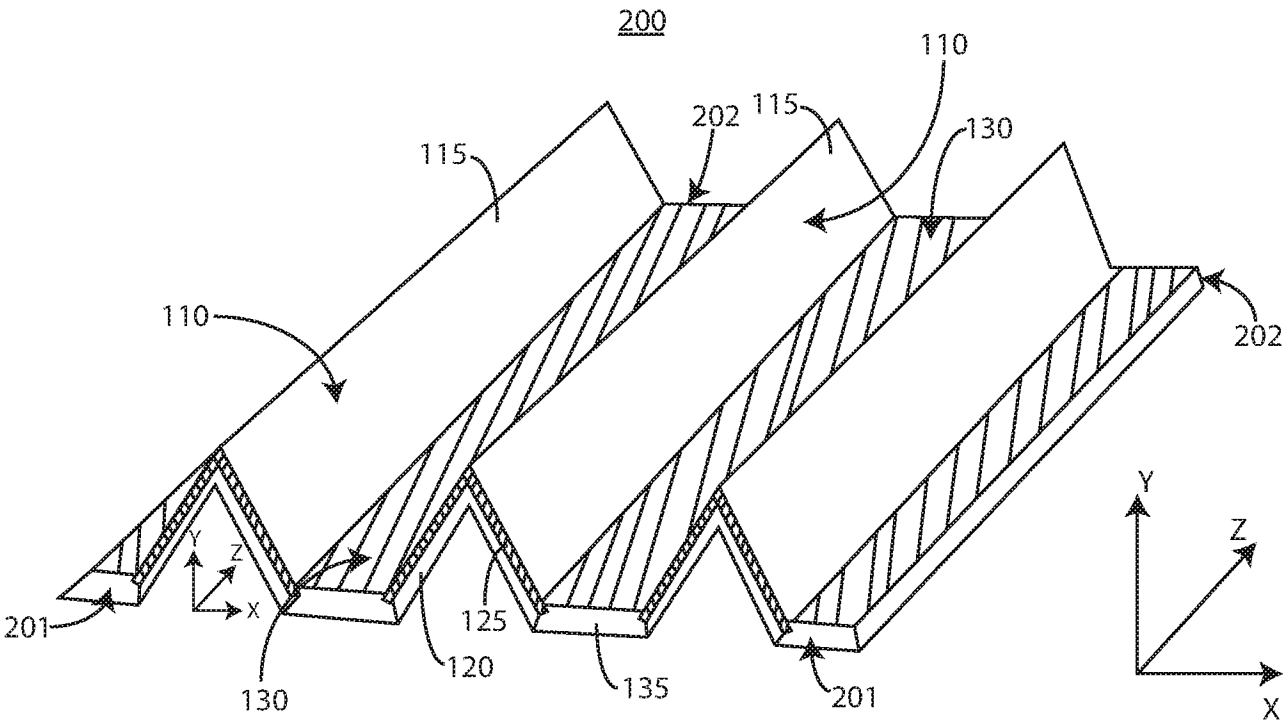
FIG. 2 is an exemplary illustration of a lightweight corrugated plate armor assembly for resisting penetration by both fragments and high velocity sharply pointed projectiles, according to an embodiment of the invention.

FIG. 2 is an exemplary illustration of a lightweight corrugated plate armor assembly 200, according to an embodiment of the invention. FIG. 2 shows the substantially sinusoidal profile of FIGS. 1A, 1B, and 1C, employed as a corrugated armor assembly 200, with the X-Y coordinate illustration of FIGS. 1A-1C, expanded to an X-Y-Z coordinate system of FIG. 2. Similar to FIGS. 1A-1C, FIG. 2 shows a sequence of slide regions 110 and receiving regions 130 extending in the X-direction. Structurally, FIG. 2 shows the substantially V-shaped protrusions 115 separated by the substantially flat lateral sections 135.

FIG. 2 also shows the substantially V-shaped protrusions 115 extending in the elongation the Y-direction, perpendicular to the X-direction. In the corrugated plate armor assembly 200, the substantially V-shaped protrusions also extend longitudinally in a Z-direction, perpendicular to both the X-direction and the Y-direction. FIG. 2 shows the assembly 200 having a first end 201 and a second end 203, with the Z-direction extension of the substantially V-shaped protrusions extending from the first end 201 to the second end 202. As shown, in the Z-direction, the plurality of substantially V-shaped protrusions 115 extends parallel to each other. FIG. 2 also shows the substantially flat lateral sections 135 extending from the first end 201 to the second end 202 in the Z-direction between the "valleys" created by adjacent substantially V-shaped protrusions.

As outlined above, each substantially V-shaped protrusion 115 includes the polyurea coating 125 over the backing material 120, which may be steel, aluminum, composite, or any other material known for being used as lightweight armor. Each substantially flat lateral section 135 may be made from high strength steel or the like. It should be noted that the specific thicknesses T, t, and $t_c$, as well as apex angle $\alpha$, and matching base angles $\beta$, as outlined above, are also applicable to the embodiment of FIG. 2. Thus, for example, the backing material thickness t may be about ⅛ inches to about ⅜ inches, and the polyurea coating thickness $t_c$ may be about 1/16 inches In operation, the corrugated plate armor assembly 200 works as outlined above with respect to FIG. 1C. Thus, the substantially V-shaped protrusions 115 of the slide region 110, includes the lightweight backing material 120 as well as the polyurea coating 125. When the high velocity sharply pointed projectile 10 strikes the protrusion 115, instead of penetrating into the surface, the projectile 10 slides downwards and is redirected in an off-axis orientation towards the receiving region 130, at which point the projectile is stopped. As noted above with respect to the profile of FIGS. 1A-1C, the corrugated plate armor assembly 200 includes backing material 120 and high strength material of section 135 which are known for resisting fragments. Thus, the assembly 200 is effective at protecting against both fragments and high velocity sharply pointed projectiles.

Figure 3:
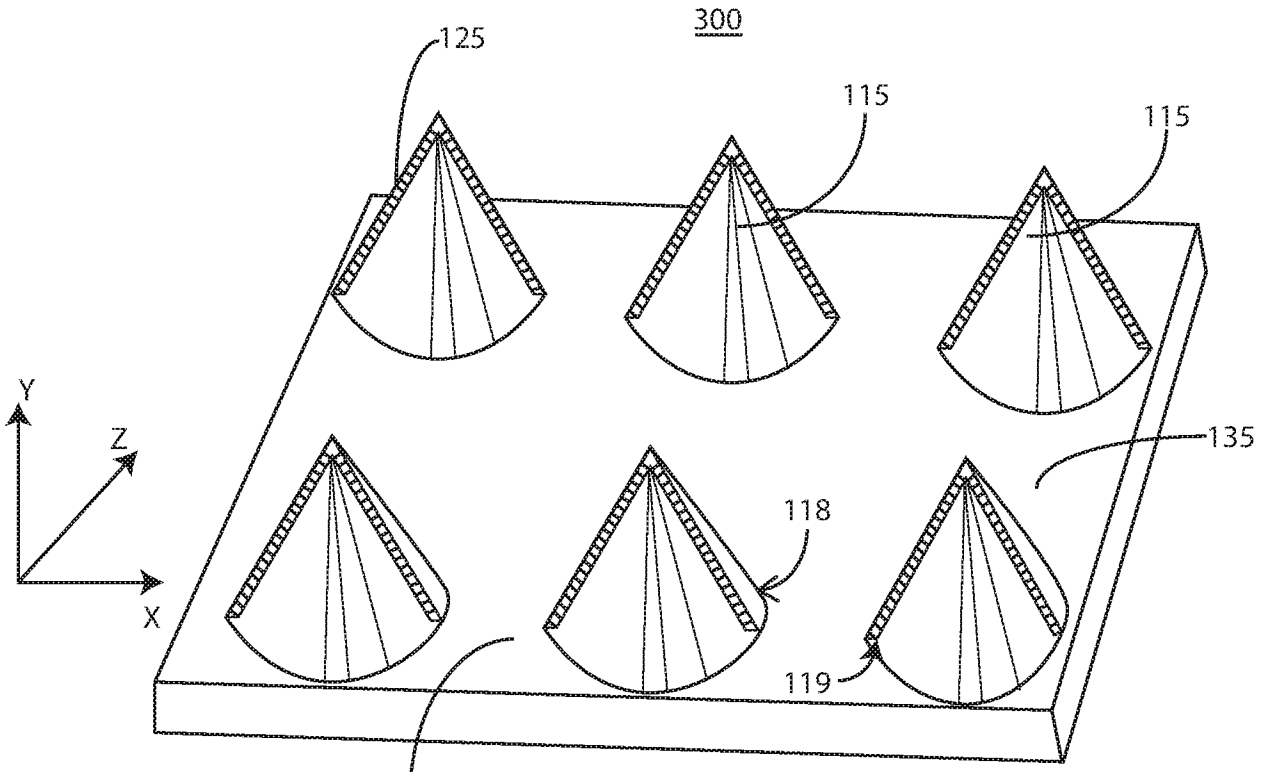
FIG. 3 is an exemplary illustration of a lightweight 3-dimensional armor assembly for resisting penetration by both fragments and high velocity sharply pointed projectiles, according to an embodiment of the invention.

FIG. 3 is an exemplary illustration of a lightweight 3-dimensional armor assembly 300, according to an embodiment of the invention. FIG. 3 shows the substantially sinusoidal profile of FIGS. 1A, 1B, and 1C, employed as the lightweight 3-dimensional assembly 300, with the X-Y coordinate illustration of FIGS. 1A-1C, expanded to an X-Y-Z coordinate system of FIG. 3. As illustrated, the substantially V-shaped protrusions 115 are right circular cones, and the substantially flat lateral sections 135 are between the cones 115 and extend from the base of one cone to another. FIG. 3 also shows the substantially V-shaped protrusions 115, i.e., the cones spaced apart from each other in both the X-direction and the Z-direction. As shown, the substantially flat lateral sections 135 extend between the cones 115 in the X-Z plane.

As outlined above, each substantially V-shaped protrusion 115, i.e., each right circular cone includes the polyurea coating 125 over the backing material 120, which may be steel, aluminum, composite, or any other material known for being used as lightweight armor. Each substantially flat lateral section 135 may be made from high strength steel or the like. Again, it should be noted that the specific thicknesses T, t, and $t_c$, as outlined above, are also applicable to lightweight 3-dimensional armor assembly 300. Thus, for example, the backing material thickness t may be about ⅛ inches to about ⅜ inches, and the polyurea coating thickness $t_c$ may be about 1/16 inches to about ⅕ inches. Regarding the angles, the apex angle $\alpha$ is the angle at the vertex of the cone 115, and the base angle $\beta$ is the angle a slanted side S makes with the base. As stated above, $\alpha$ may be about 30 degrees to about 60 degrees. According to a specific embodiment, $\alpha$ is about 45 degrees or less.

In operation, the lightweight 3-dimensional armor assembly 300 works as outlined above with respect to FIG. 1C. Thus, when a high velocity sharply pointed projectile 10 strikes the cone 115, instead of penetrating into the surface, the projectile 10 slides downwards and is redirected in an off-axis orientation towards the receiving region 130, at which point the projectile is stopped. As noted above with respect to the profile of FIGS. 1A-1C, the lightweight 3-dimensional armor assembly 300 includes backing material 120 and high strength material of section 135, which are known for resisting fragments. Thus, the assembly 300 is effective at protecting against both fragments and high velocity sharply pointed projectiles.

Figure 4A:
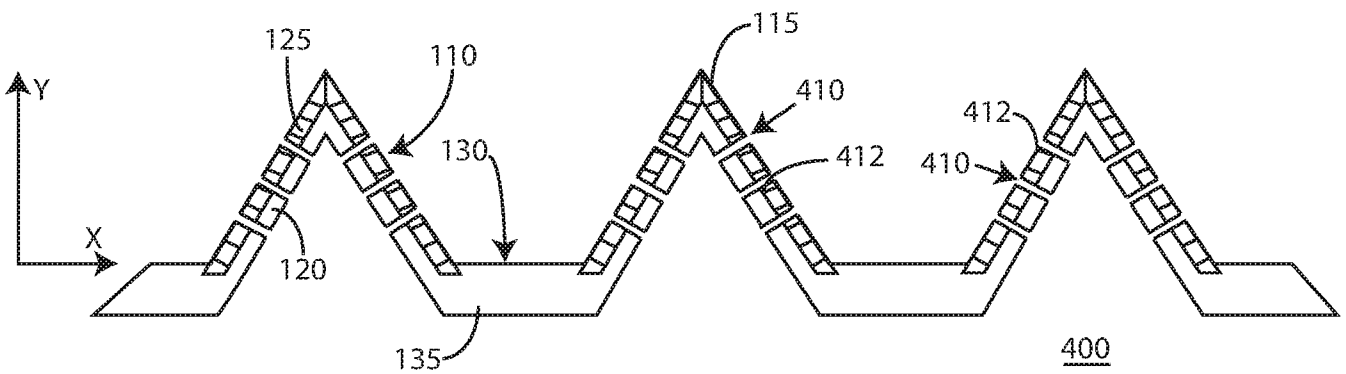
FIG. 4A is an exemplary sectional illustration of a lightweight armor assembly for resisting penetration by both fragments and high velocity sharply pointed projectiles, according to an embodiment of the invention.

FIG. 4A is an exemplary sectional illustration of a lightweight armor assembly 400 for resisting penetration by both fragments and high velocity sharply pointed projectiles, according to an embodiment of the invention. As outlined below, the assembly 400 is essentially the assembly 100 of FIG. 1A, with the addition of holes 410. Thus, like elements are labelled accordingly, and operate as outlined above, with respect to FIG. 1A. The thicknesses T, t, and $t_c$, as well as the apex angle $\alpha$, and matching base angles $\beta$ are applicable to FIG. 4A and are as outlined in the description of FIG. 1B.

As shown, FIG. 4A shows the substantially V-shaped protrusions 115 having holes 410. At the area surrounding these holes 410, ridges 412 are formed. Because of the close similarities between the assembly 100 of FIG. 1A and assembly 400 of FIG. 4A, both assemblies act similarly to protect against projectiles. Thus, in the lightweight armor assembly 400, when a high velocity sharply pointed projectile strikes the surface in the slide region 110 the polyurea coating 125 converts to a transient liquid phase, thereby causing the projectile to slide off the surface, redirecting it downwards towards the receiving region 130. When projectiles (both high velocity sharply pointed and fragments) strike the ridges 412, the impact may fragment the projectiles. The impact may also redirect fragments, turning them off-axis, in a more dramatic way as compared to when striking the surface as outlined with respect to FIG. 1C. The redirected projectiles/fragments are directed towards the receiving region 130 were they stopped at the thickened section 140.

Figure 4B:
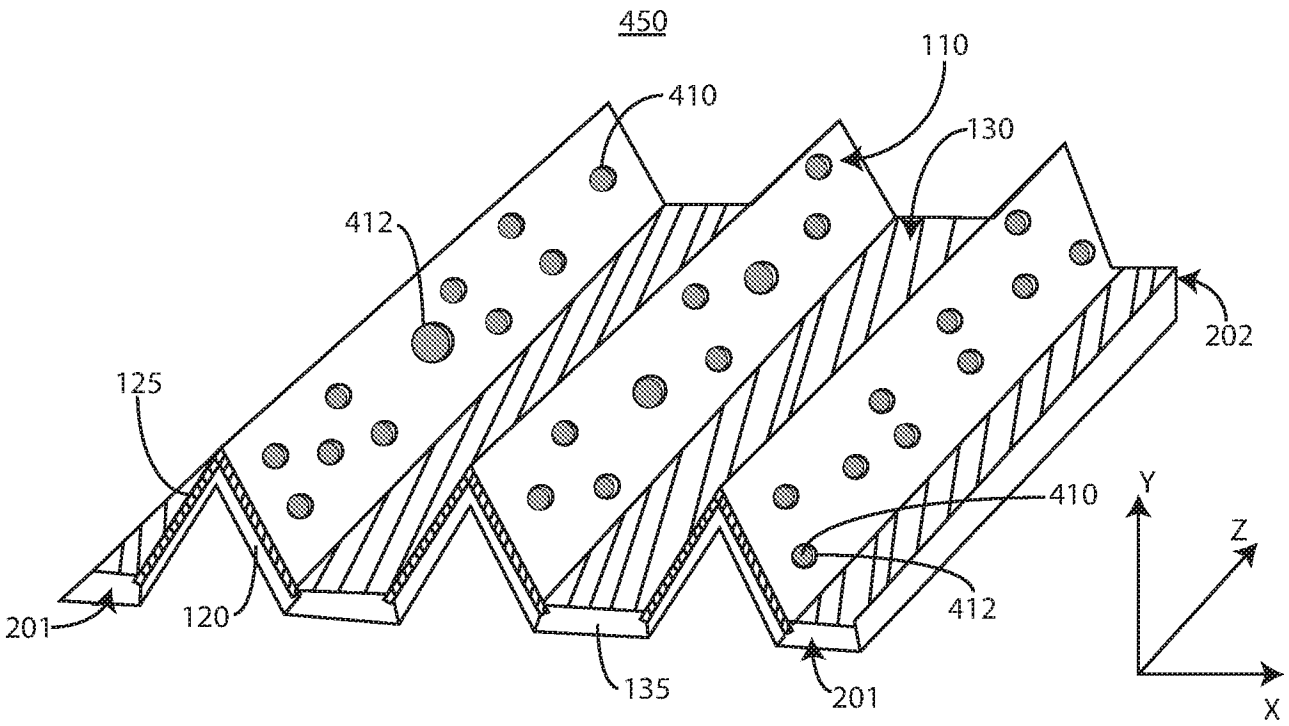
FIG. 4B is an exemplary illustration of a lightweight corrugated plate armor assembly for resisting penetration by both fragments and high velocity sharply pointed projectiles, according to an embodiment of the invention.

FIG. 4B is an exemplary illustration of a lightweight corrugated plate armor assembly 450, according to an embodiment of the invention. FIG. 4B shows the substantially sinusoidal profile of FIG. 4A, employed as a corrugated armor assembly 450. As compared to FIG. 4A, the X-Y coordinate illustration is expanded to an X-Y-Z coordinate system of FIG. 4B.

The embodiment of FIG. 4B is essentially the lightweight corrugated plate armor assembly 200, with the inclusion of the holes 410 and ridges 412. Like elements are labelled accordingly, and operate similarly. Thus, in addition to operating to stop projectiles as described above in reference to FIGS. 1C and 2, the holes 410 and ridges 412 shown in FIG. 4B also fragment and redirect projectiles towards the receiving region 130 were they stopped at the substantially flat lateral section 135.

Figure 4C:
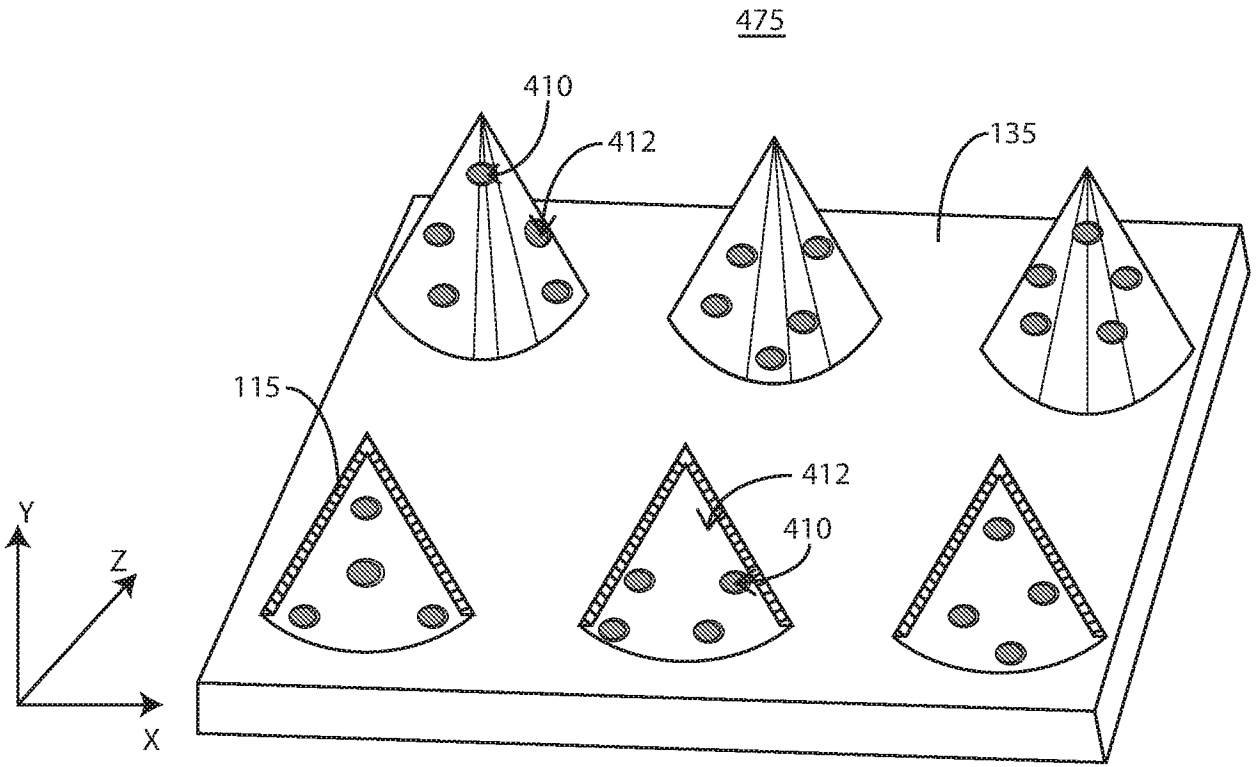
FIG. 4C is an exemplary illustration of a lightweight 3-dimensional armor assembly for resisting penetration by both fragments and high velocity sharply pointed projectiles, according to an embodiment of the invention.

FIG. 4C is an exemplary illustration of a lightweight 3-dimensional armor assembly 475 for resisting penetration by both fragments and high velocity sharply pointed projectiles, according to an embodiment of the invention. FIG. 4C shows the substantially sinusoidal profile of FIG. 4A, employed as the lightweight 3-dimensional assembly 475. As compared to FIG. 4A, the X-Y coordinate illustration is expanded to an X-Y-Z coordinate system of FIG. 4C.

The embodiment of FIG. 4C is essentially the 3-dimensional armor assembly 300, with the inclusion of the holes 410 and ridges 412. Like elements are labelled accordingly, and operate similarly. Thus, in addition to operating to stop projectiles as described above in reference to FIGS. 1C and 3, the holes 410 and ridges 412 shown in FIG. 4C also fragment and redirect projectiles towards the receiving region 130 were they stopped at the thickened section 140.

Figure 5A:
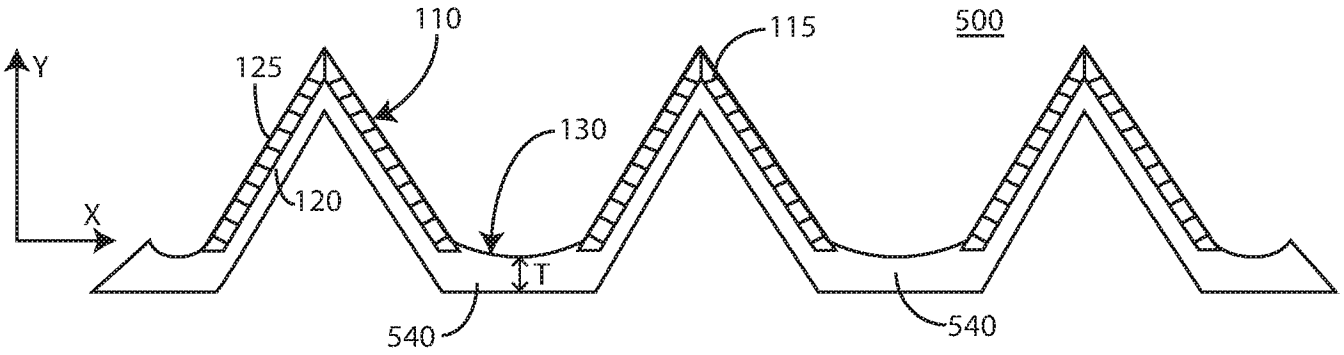
FIG. 5A is an exemplary sectional illustration of a lightweight armor assembly for resisting penetration by both fragments and high velocity sharply pointed projectiles, according to an embodiment of the invention.

FIG. 5A is an exemplary sectional illustration of a lightweight armor assembly 500 for resisting penetration by both fragments and high velocity sharply pointed projectiles, according to an embodiment of the invention. As outlined below, the assembly 500 is essentially the assembly 100 of FIG. 1A, in which the substantially flat lateral section 135 is a graded thickened section 540. As shown, the thickened section 540 has a concave upper surface. As shown, the curvature of the concave surface extends from the base 119 of one substantially V-shaped protrusions 115 to the base 119 of an adjacent substantially V-shaped protrusion 115. Otherwise, like elements are labelled accordingly, and operate as outlined above, with respect to FIG. 1A. The thicknesses T, t, and $t_c$, as well as the apex angle $\alpha$ and matching base angles $\beta$ are applicable to FIG. 5A and are as outlined in the description of FIG. 1B.

The lightweight armor assembly 500 operates as outlined above with in reference to FIG. 1C. Thus, upon striking the slide region 110, high velocity sharply pointed projectiles slide off the surface and are redirected towards the receiving region 130. At the receiving region 130 in assembly 500, the graded thickened section 540 stops the projectile. The concave upper surface reduces the chances of "head-on" strikes that are capable penetrating into the thickened section 540.

Figure 5B:
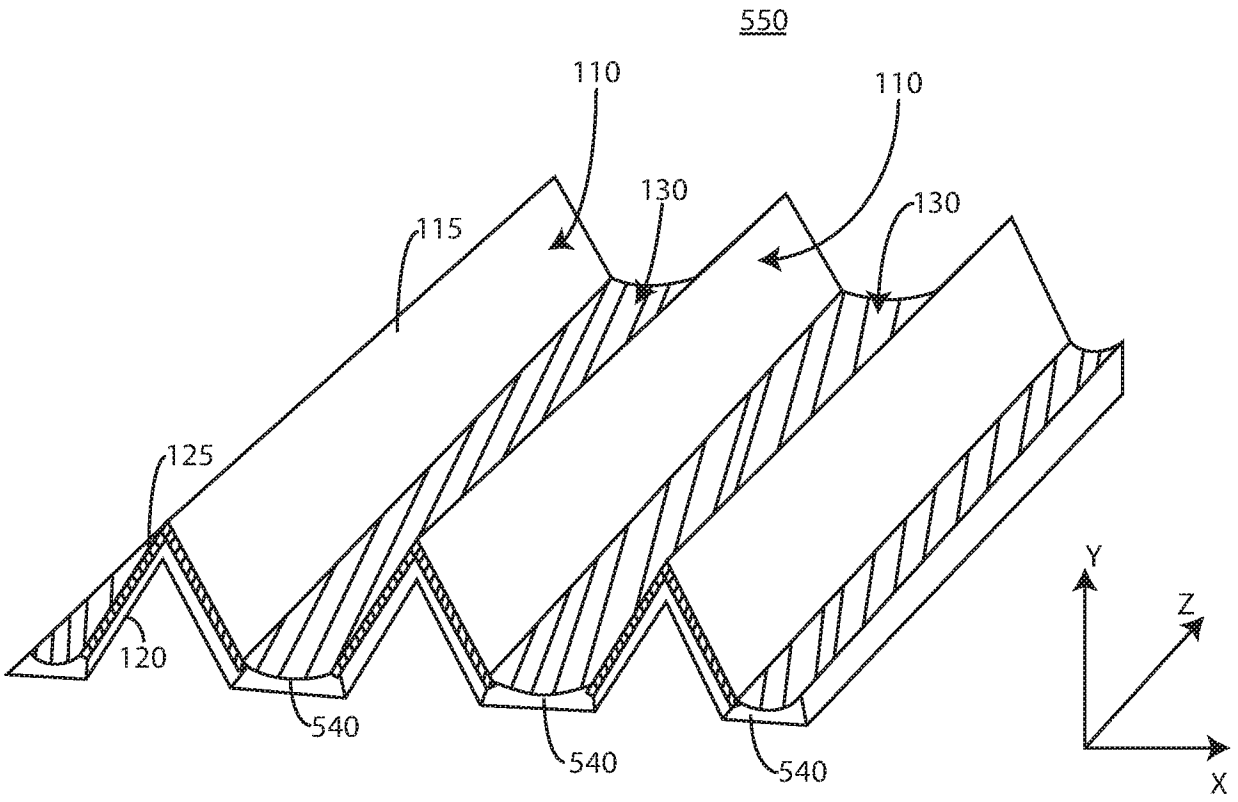
FIG. 5B is an exemplary illustration of a lightweight corrugated plate armor assembly for resisting penetration by both fragments and high velocity sharply pointed projectiles, according to an embodiment of the invention.

FIG. 5B is an exemplary illustration of a lightweight corrugated plate armor assembly 550, according to an embodiment of the invention. FIG. 5B shows the substantially sinusoidal profile of FIG. 5A, employed as a corrugated armor assembly 550. As compared to FIG. 5A, the X-Y coordinate illustration is expanded to an X-Y-Z coordinate system of FIG. 5B. FIG. 5B shows the receiving region 130 having the graded thickened section 540 with a concave upper surface. As stated above, in operation, upon striking the slide region 110, high velocity sharply pointed projectiles slide off the surface and are redirected towards the receiving region 130. There the graded thickened section stops the projectiles, with the concave shape facilitating a reduced number of head-on collisions with the projectiles.

Figure 5C:
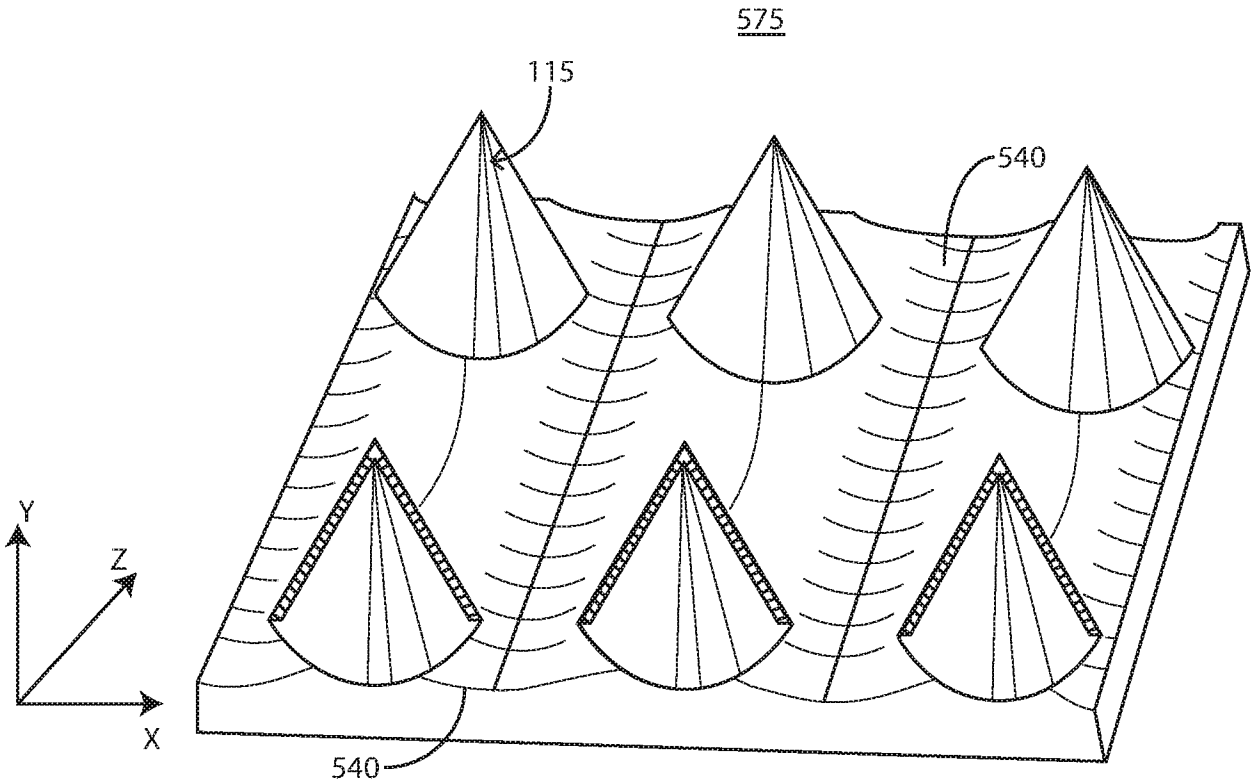
FIG. 5C is an exemplary illustration of a lightweight 3-dimensional armor assembly for resisting penetration by both fragments and high velocity sharply pointed projectiles, according to an embodiment of the invention.

FIG. 5C is an exemplary illustration of a lightweight 3-dimensional armor assembly 575 for resisting penetration by both fragments and high velocity sharply pointed projectiles, according to an embodiment of the invention. FIG. 5C shows the substantially sinusoidal profile of FIG. 5A, employed as the lightweight 3-dimensional assembly 575. As compared to FIG. 5A, the X-Y coordinate illustration is expanded to an X-Y-Z coordinate system of FIG. 5C. FIG. 5C shows the receiving region 130 between the cones 115 having the substantially flat lateral section 535 with a concave upper surface. As stated above, in operation, upon striking the slide region 110, high velocity sharply pointed projectiles slide off the surface and are redirected towards the receiving region 130. There the substantially flat lateral section 535 stops the projectiles, with the concave shape facilitating a reduced number of head-on collisions with the projectiles.

Figure 6A:
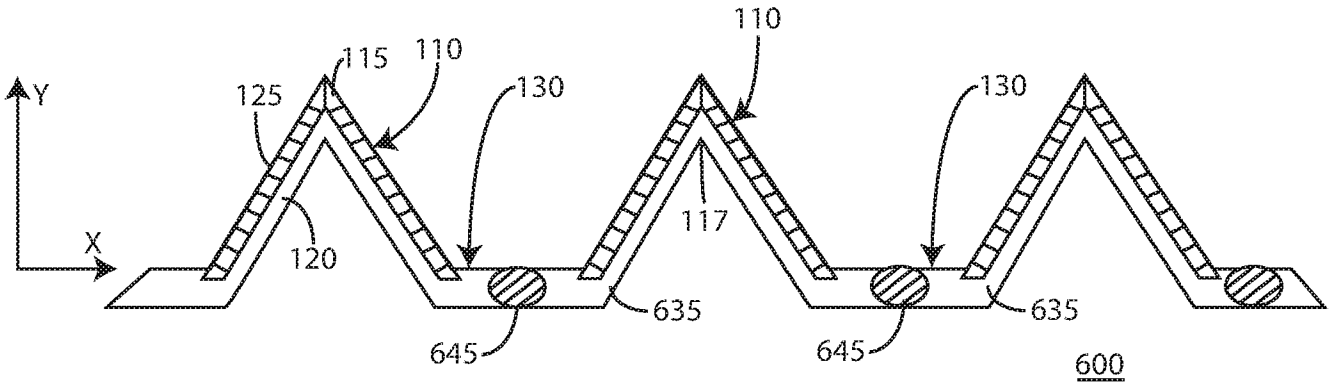
FIG. 6A is an exemplary sectional illustration of a lightweight armor assembly for resisting penetration by both fragments and high velocity sharply pointed projectiles, according to an embodiment of the invention.

FIG. 6A is an exemplary sectional illustration of a lightweight armor assembly 600 for resisting penetration by both fragments and high velocity sharply pointed projectiles, according to an embodiment of the invention. As outlined below, the assembly 600 is essentially the assembly 100 of FIG. 1A, in which the substantially flat lateral section 635 of the receiving region 130 has a ceramic plug 645. The ceramic plug 645 may be fixedly positioned by known means into the high strength material of the substantially flat lateral section 635. Otherwise, like elements are labelled accordingly, and operate as outlined above, with respect to FIG. 1A. The thicknesses T, t, and $t_c$, as well as the apex angle $\alpha$, and matching base angles $\beta$ are applicable to FIG. 6A and are as outlined in the description of FIG. 1B.

The lightweight armor assembly 600 operates as outlined above with in reference to FIG. 1C. Thus, upon striking the slide region 110, high velocity sharply pointed projectiles slide off the surface and are redirected towards the receiving region 130. At the receiving region 130 in assembly 600, the substantially flat lateral section 635 stops the projectile. The ceramic plug 645 may comprise most of section 635, and thus may stop the projectile.

Figure 6B:
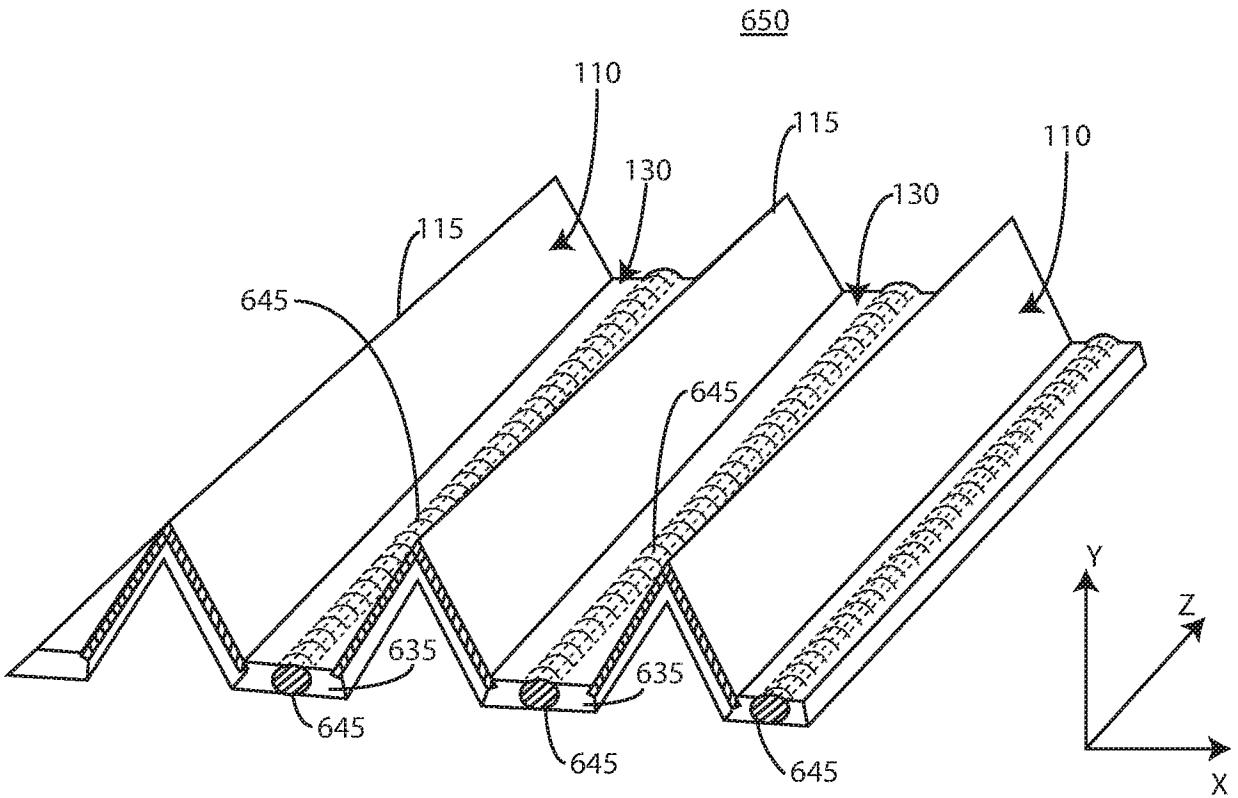
FIG. 6B is an exemplary illustration of a lightweight corrugated plate armor assembly for resisting penetration by both fragments and high velocity sharply pointed projectiles, according to an embodiment of the invention.

FIG. 6B is an exemplary illustration of a lightweight corrugated plate armor assembly 650, according to an embodiment of the invention. FIG. 6B shows the substantially sinusoidal profile of FIG. 6A, employed as a corrugated armor assembly 650. As compared to FIG. 6A, the X-Y coordinate illustration is expanded to an X-Y-Z coordinate system of FIG. 6B. FIG. 6B shows the receiving region 130 having the substantially flat lateral section 635 with the ceramic plug 645. As shown, according to an embodiment, the ceramic plug sections may crisscross, with ceramic plug sections running in perpendicular directions. Alternatively, the ceramic plugs may run in one direction only and there is no crisscrossing pattern. As stated above, in operation, upon striking the slide region 110, high velocity sharply pointed projectiles slide off the surface and are redirected towards the receiving region 130. There the substantially flat lateral section 635 with the ceramic plug 645 section stops the projectiles.

Figure 6C:
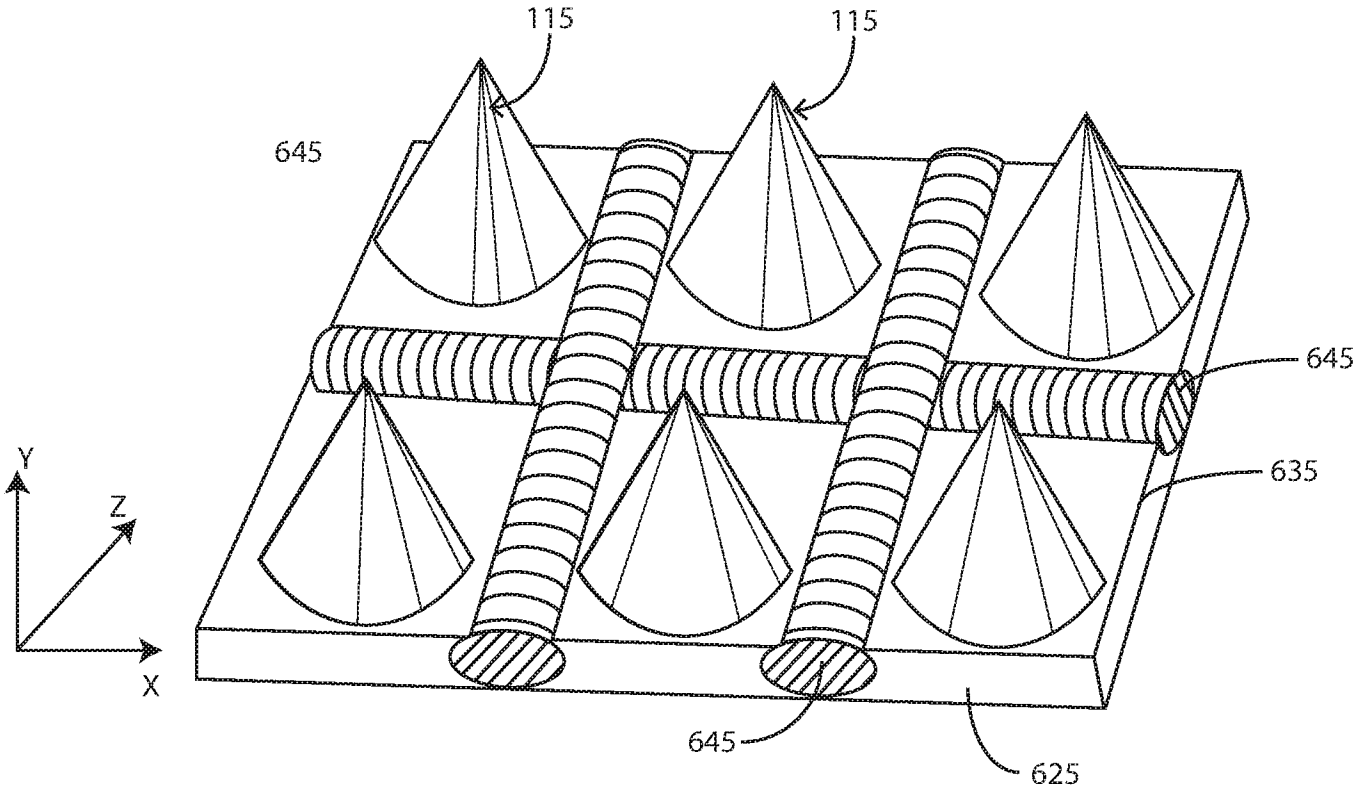
FIG. 6C is an exemplary illustration of a lightweight 3-dimensional armor assembly for resisting penetration by both fragments and high velocity sharply pointed projectiles, according to an embodiment of the invention.

FIG. 6C is an exemplary illustration of a lightweight 3-dimensional armor assembly 675 for resisting penetration by both fragments and high velocity sharply pointed projectiles, according to an embodiment of the invention. FIG. 6C shows the substantially sinusoidal profile of FIG. 6A, employed as the lightweight 3-dimensional assembly 675. As compared to FIG. 6A, the X-Y coordinate illustration is expanded to an X-Y-Z coordinate system of FIG. 6C. FIG. 5C shows the receiving region 130 between the cones 115 having the substantially flat lateral section 635 with the ceramic plug 645. As stated above, in operation, upon striking the slide region 110, high velocity sharply pointed projectiles slide off the surface and are redirected towards the receiving region 130. There the substantially flat lateral section 635 with the ceramic plug 645 stops the projectiles.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention. For example in the embodiments illustrated in FIGS. 3, 4C, 5C, and 6C, the substantially V-shaped protrusions may have an ellipsoid shape. Also, the spacing between the substantially V-shaped protrusions 115 may be adjusted to be closer together or farther apart. The invention including the stated variations is intended to be defined by the following claims and their equivalents, in which all terms are meant in their broadest reasonable sense unless otherwise indicated.

What is claimed is:

1. A lightweight armor assembly for resisting penetration by both fragments and high velocity sharply pointed projectiles, the lightweight armor assembly comprising:

a structure having a substantially sinusoidal profile in an X-Y coordinate reference system, comprising:

a plurality of slide regions for slidably redirecting high velocity projectiles, each slide region comprising a substantially V-shaped protrusion elongated in the Y-direction, having an apex and a base, wherein each substantially V-shaped protrusion comprises, a backing material having a thickness t; and a polyurea coating over the backing material, the polyurea coating having a thickness $t_c$, said polyurea coating being converted to a lubricated slide surface when contacted by said high velocity projectiles, and a plurality of receiving regions for receiving and stopping high velocity projectiles, either redirected from the sliding region or emanating from another source, each receiving region comprising:

a substantially flat lateral section wherein the substantially flat lateral section does not form a continuous curved parabolic shape with the substantially V-shaped protrusion elongated in the Y-direction, the substantially flat lateral section having a thickness T, thicker than the backing material thickness t, extending in the X-direction between the substantially V-shaped protrusions and contacting each substantially V-shaped protrusion at a respective base of said plurality of slide regions, and wherein the substantially flat lateral section does not include a polyurea coating.

2. The lightweight armor assembly of claim 1, wherein in the substantially sinusoidal profile, the thickness t of the backing material is ⅛ inches to ⅜ inches, the thickness $t_c$ of the polyurea coating is 1/16 inches to ⅕ inches, and the thickness T of the substantially flat lateral section is ⅝ inches to 1 inch.

3. The lightweight armor assembly of claim 2, wherein in the substantially sinusoidal profile, each of the substantially V-shaped protrusions has an apex angle $\alpha$ that is 45 degrees.

4. The lightweight armor assembly of claim 3, wherein the structure having a substantially sinusoidal profile is a corrugated plate in an X-Y-Z coordinate reference system, the corrugated plate having a first end and a second end, wherein each substantially V-shaped protrusion extends from the first end to the second end in the Z-direction, the plurality of substantially V-shaped protrusions extending parallel to each other in said Z-direction, and wherein each substantially flat lateral section extends from the first end to the second end in said Z-direction, the plurality of substantially flat lateral sections extending parallel to each other in said Z-direction.

5. The lightweight armor assembly of claim 4, wherein the substantially V-shaped protrusions have holes which form ridges for stopping and/or redirecting projectiles towards the receiving region.

6. The lightweight armor assembly of claim 4, wherein each of the substantially flat lateral sections of the respective receiving regions comprise steel.

7. The lightweight armor assembly of claim 4, wherein each of the substantially flat lateral sections comprise steel having a concave upper surface.

8. The lightweight armor assembly of claim 4, wherein each of the substantially flat lateral sections comprises a steel portion having a ceramic plug inserted therein.

9. The lightweight armor assembly of claim 3, wherein the structure having a substantially sinusoidal profile is a 3 dimensional plate in an X-Y-Z coordinate reference system, in which the substantially V-shaped protrusions are right circular cones elongated in the Y-direction and spaced apart in the X-Z plane, and in which the plurality of receiving regions extend between the cones in said X-Z plane.

10. The lightweight armor assembly of claim 9, wherein the cones have holes which form ridges therein for stopping and/or redirecting projectiles towards the receiving region.

11. The lightweight armor assembly of claim 9, wherein each of the substantially flat lateral sections of the respective receiving regions comprises steel.

12. The lightweight armor assembly of claim 9, wherein each of the substantially flat lateral sections of the respective receiving regions comprises steel having a concave upper surface.

13. The lightweight armor assembly of claim 9, wherein each of the substantially flat lateral sections of the respective receiving regions comprises steel having a ceramic plug inserted therein.

* * * * *